US009161888B2

(12) United States Patent
Lamar

(10) Patent No.: US 9,161,888 B2
(45) Date of Patent: Oct. 20, 2015

(54) PACIFIER APPARATUS

(76) Inventor: Michelle Lamar, Brentwood, CA (US)

( * ) Notice: Subject to any disclaimer, the term of this patent is extended or adjusted under 35 U.S.C. 154(b) by 878 days.

(21) Appl. No.: 12/353,113

(22) Filed: Jan. 13, 2009

(65) Prior Publication Data

US 2010/0179593 A1 Jul. 15, 2010

(51) Int. Cl.
*A61J 17/00* (2006.01)

(52) U.S. Cl.
CPC ..... *A61J 17/00* (2013.01); *A61J 1/1418* (2015.05); *A61J 17/007* (2015.05)

(58) Field of Classification Search
CPC ..... A61J 17/00–17/008; A61J 17/02
USPC ..... 606/234–236
See application file for complete search history.

(56) References Cited

U.S. PATENT DOCUMENTS

| | | | | |
|---|---|---|---|---|
| 2,258,174 | A | 10/1941 | Chawner | |
| 2,462,786 | A | 2/1949 | Steckler | |
| 2,699,785 | A | 2/1953 | Allen | |
| 2,687,302 | A | 8/1954 | Stiegler | |
| 2,743,727 | A * | 5/1956 | Griesinger | 606/236 |
| 2,784,526 | A | 3/1957 | Bounadere | |
| 3,395,462 | A | 8/1968 | Sebree | |
| 3,519,273 | A | 7/1970 | Viby | |
| 3,605,324 | A | 9/1971 | Adams | |
| 3,633,587 | A | 1/1972 | Hunt | |
| 3,768,202 | A | 10/1973 | Wheelock | |
| 3,841,039 | A | 10/1974 | Farnsworth | |
| 3,853,412 | A | 12/1974 | Griffin | |
| 3,889,950 | A | 6/1975 | Kasravi | |
| D249,161 | S | 8/1978 | Rohrig | |
| 4,143,452 | A | 3/1979 | Hakim | |
| 4,170,106 | A | 10/1979 | Koslosky | |
| 4,274,222 | A | 6/1981 | Zahn | |
| 4,277,910 | A | 7/1981 | Kramer | |
| 4,309,852 | A | 1/1982 | Stolpin | |
| 4,321,927 | A | 3/1982 | Lynch | |
| 4,836,787 | A | 6/1989 | Boo | |
| 5,013,321 | A | 5/1991 | MacVane | |
| 5,035,425 | A | 7/1991 | Edwards | |
| 5,059,215 | A | 10/1991 | Girau | |
| RE34,128 | E | 11/1992 | Lorhpipat | |
| D332,982 | S | 2/1993 | Norman | |
| 5,211,656 | A | 5/1993 | Maddocks | |
| 5,219,162 | A | 6/1993 | Orbanes | |
| 5,224,959 | A | 7/1993 | Kasper | |
| 5,236,196 | A | 8/1993 | Blankenburg | |
| 5,403,349 | A | 4/1995 | Rohrig | |

(Continued)

FOREIGN PATENT DOCUMENTS

GB 2419535 * 3/2006

OTHER PUBLICATIONS

International Search Report dated Nov. 11, 2010 for corresponding PCT/US2010/020811 filed Jan. 12, 2010.

*Primary Examiner* — Tuan V Nguyen
*Assistant Examiner* — Lindsey Bachman
(74) *Attorney, Agent, or Firm* — West & Associates, A PC; Stuart J. West; Shaun Sluman

(57) ABSTRACT

A pacifier apparatus comprising a plurality of framing elements forming a hollow-bodied member, a planar surface within an aperture defined by the hollow-bodied member, and a nipple assembly with a nipple extending through an opening in the planar surface from a first side of the planar surface beyond a second side of the planar surface.

18 Claims, 8 Drawing Sheets

(56) References Cited

U.S. PATENT DOCUMENTS

| | | | | |
|---|---|---|---|---|
| D359,327 | S | 6/1995 | Gould | |
| 5,813,366 | A | 9/1998 | Mauldin, Jr. | |
| 5,832,877 | A | 11/1998 | Markham | |
| 5,843,128 | A | 12/1998 | Wexler | |
| D408,921 | S | 4/1999 | Wexler | |
| D411,042 | S | 6/1999 | Willinger | |
| 5,908,438 | A | 6/1999 | Munoz | |
| 5,924,908 | A | 7/1999 | O'Heir | |
| 5,947,061 | A | 9/1999 | Markham | |
| 5,993,478 | A | 11/1999 | Nowak | |
| 6,056,774 | A | 5/2000 | Johansen | |
| 6,063,107 | A * | 5/2000 | Wexler | 606/234 |
| 6,065,967 | A | 5/2000 | Garita | |
| 6,098,571 | A | 8/2000 | Axelrod | |
| 6,139,566 | A * | 10/2000 | Bennett | 606/236 |
| 6,148,771 | A | 11/2000 | Costello | |
| 6,217,408 | B1 | 4/2001 | Willinger | |
| 6,220,980 | B1 | 4/2001 | Adler | |
| 6,221,447 | B1 | 4/2001 | Munn | |
| 6,228,105 | B1 | 5/2001 | Johansen | |
| 6,237,538 | B1 | 5/2001 | Tsengas | |
| 6,241,110 | B1 | 6/2001 | Hakim | |
| D447,441 | S | 9/2001 | Veach | |
| 6,418,673 | B1 | 7/2002 | Flowerday | |
| 6,439,166 | B1 | 8/2002 | Markham | |
| D473,350 | S | 4/2003 | Willinger | |
| 6,575,999 | B1 | 6/2003 | Rohrig | |
| D477,441 | S | 7/2003 | Willinger et al. | |
| 6,609,944 | B1 | 8/2003 | Viola | |
| D479,897 | S | 9/2003 | Willinger | |
| 6,622,659 | B2 * | 9/2003 | Willinger | 119/702 |
| 6,634,919 | B2 * | 10/2003 | Gordon et al. | 446/73 |
| 6,651,590 | B2 * | 11/2003 | Willinger et al. | 119/707 |
| 6,666,740 | B1 * | 12/2003 | Schneider | 446/72 |
| 6,680,359 | B2 | 1/2004 | Schoenheider | |
| 6,699,264 | B1 * | 3/2004 | Rohrig | 606/234 |
| D489,494 | S | 5/2004 | Silvergate | |
| 6,729,984 | B2 | 5/2004 | Silverglate | |
| 6,767,357 | B2 | 7/2004 | Uehara | |
| D497,191 | S | 10/2004 | Shore | |
| D501,961 | S | 2/2005 | Jager | |
| 6,871,751 | B2 | 3/2005 | Kerns | |
| D511,029 | S | 10/2005 | Willinger | |
| D514,263 | S | 1/2006 | Willinger | |
| 7,017,523 | B2 | 3/2006 | Handelsman | |
| 7,063,044 | B2 | 6/2006 | Handelsman | |
| 7,122,045 | B2 | 10/2006 | Randolph | |
| 7,144,293 | B2 | 12/2006 | Mann | |
| 7,214,239 | B2 | 5/2007 | Chen | |
| D549,889 | S | 8/2007 | Winkler | |
| D558,354 | S | 12/2007 | Roehrig | |
| 7,311,721 | B2 | 12/2007 | Rosuck | |
| D563,609 | S | 3/2008 | Gick | |
| 7,374,469 | B2 | 5/2008 | Lin | |
| 7,389,748 | B2 | 6/2008 | Shatoff | |
| D583,113 | S | 12/2008 | Simon | |
| 7,500,984 | B2 | 3/2009 | Fuisz | |
| D596,248 | S | 7/2009 | Silvergate | |
| 7,576,171 | B2 | 8/2009 | Crawford | |
| 7,640,894 | B2 | 1/2010 | Jager | |
| 8,052,552 | B2 * | 11/2011 | Silverglate | 473/571 |
| 2002/0087191 | A1 | 7/2002 | Huang | |
| 2002/0124811 | A1 | 9/2002 | Willinger | |
| 2004/0134136 | A1 | 7/2004 | Shearing | |
| 2005/0251211 | A1 * | 11/2005 | Knifong | 606/234 |
| 2007/0021783 | A1 | 1/2007 | Viana | |
| 2008/0188894 | A1 | 8/2008 | Hakim | |
| 2008/0215092 | A1 | 9/2008 | Smith | |
| 2009/0170645 | A1 | 7/2009 | Silvergate | |
| 2009/0170646 | A1 | 7/2009 | Silvergate | |
| 2009/0287247 | A1 | 11/2009 | Chipperson | |
| 2010/0056310 | A1 | 3/2010 | Silvergate | |
| 2010/0152774 | A1 | 6/2010 | Branham | |
| 2010/0179593 | A1 | 7/2010 | Lamar | |
| 2010/0201033 | A1 | 8/2010 | Willinger | |

* cited by examiner

PACIFIER APPARATUS

BACKGROUND

1. Field of the Invention

The present disclosure relates to the field of child care accessories, specifically a hollow-bodied ball with an attached pacifier.

2. Background

Parents and caregivers often use pacifiers to calm down a fussy or teething baby. However, when a baby opens its mouth the pacifier usually falls out and a parent or caregiver has to pick it up and put it back in the baby's mouth. Since babies are in the early stages of development, they have limited motor skills and cannot accomplish this task by themselves. Moreover, it can be very frustrating for both the baby and parent or caregiver when a pacifier repeatedly falls out over a short period of time.

Currently, there are several pacifiers on the market. Some pacifiers have small rings attached to them for easy handling by a parent or other caregiver, such as the Pacifiers for Day and Night Use manufactured by Born Free®. However, even with ring embellishments these pacifiers tend to be small and difficult for a baby or small child to handle or pick up if they fall out of his or her mouth. Traditional pacifiers also offer little interest to a baby or small child when not in the mouth, thus making it necessary for a parent or caregiver to have separate toys on hand to keep the child occupied and content.

What is needed is a large, hollow-bodied apparatus with an attached pacifier nipple such that a baby can hold the apparatus while sucking on the nipple. Such an apparatus can also have a removable teething device and embellishments that can keep a child interested in the apparatus when the pacifier nipple is not in the child's mouth.

DETAILED DESCRIPTION

Figure 1:
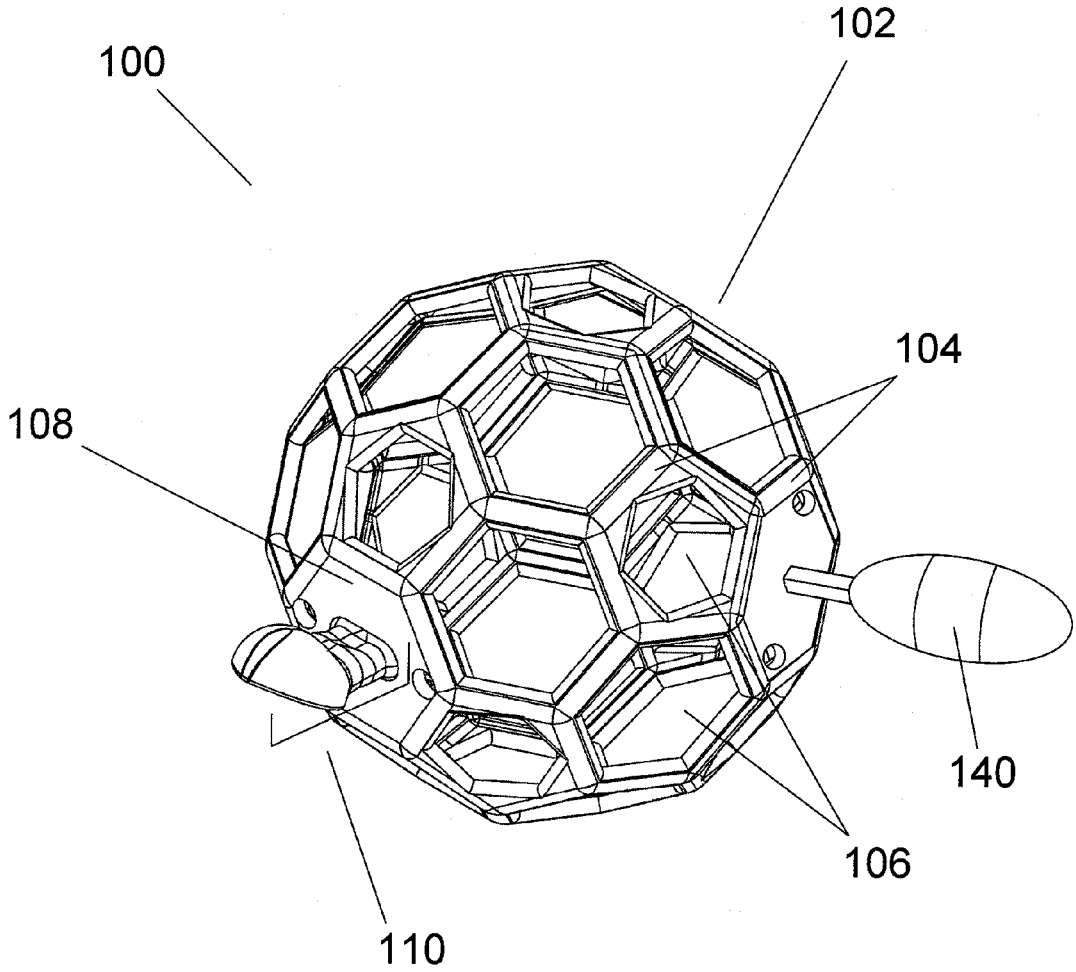
FIG. 1 depicts an isometric view of one embodiment of the present device.

FIG. 1 shows an isometric view of the present device. An apparatus 100 can be comprised of a hollow-bodied member 102. As shown in FIG. 1, a hollow-bodied member 102 can be generally spherical. In alternate embodiments, a hollow-bodied member 102 can be cubical, hexagonal or can have any other known and/or convenient geometry.

The hollow-bodied member 102 can comprise a plurality of framing elements 104 that can be interconnected. As shown in FIG. 1, the plurality of framing elements 104 can make up a substantial portion of the surface area of a hollow-bodied member 102. In alternate embodiments, a plurality of framing elements 104 can take up any other known and/or convenient amount of the surface area of a hollow-bodied member 102.

The framing elements 104 can be manufactured individually or in clusters and subsequently bonded together by adhesive, ultrasonic bonding or any other known and/or convenient method of bonding. Alternatively, a hollow-bodied member 102 can be made by injection molding. In yet another embodiment, each of a plurality of framing elements 104 can be formed by building upon a previously formed framing element 104. A hollow-bodied member 102 can also be constructed by any other known and/or convenient means.

As shown in FIG. 1, in some embodiments some members of the plurality of framing elements 104 can be hexagonal and other members of the plurality of framing elements 104 can be pentagonal. However, in alternate embodiments at least one member of a plurality of framing elements 104 can have any other known and/or convenient geometry. Furthermore, some members of a plurality of framing elements 104 can have geometry different from that of other members of the plurality of framing elements 104.

Each member of a plurality of framing elements 104 can have an aperture 106. As shown in FIG. 1, each aperture 106 can be hexagonal. In alternate embodiments at least one aperture 106 can be square, triangular, pentagonal or can have any other known and/or convenient geometry. The geometry of an aperture 106 can be different than the geometry of its corresponding framing element 104. As an example, in FIG. 1, some pentagonal framing elements 104 are depicted as having hexagonal apertures 106. Alternatively, the geometry of an aperture 106 can be the same as the geometry of its corresponding framing element 104. As an example, FIG. 1 also shows some hexagonal framing elements 104 as having hexagonal apertures 106.

Apertures 106 can also be adapted to receive a person's fingers and facilitate easy handling of the apparatus 100. As depicted in FIG. 1, an aperture 106 of a member of a plurality of framing elements 104 can be different in size than another aperture 106 of another member of a plurality of framing elements 104. Alternatively, all apertures 106 of a plurality of framing elements 104 can have the same size.

An aperture 106 in a framing element 104 can create an interior perimeter surface in the framing element 104. With respect to the plane of a framing element 104, the orthogonal interior perimeter surface can have any known and/or convenient degree of curvature. In other embodiments, the orthogonal interior perimeter surface of a framing element 104 can be planar. The orthogonal interior perimeter surface of a framing element 104 can be smooth, as shown in the embodiment in FIG. 1. Alternatively, the orthogonal interior perimeter surface of a framing element 104 can have ridges, indentations, raised portions or any other known and/or convenient surface characteristics.

A plurality of framing elements 104 can be made of plastic, metal, polymer or any other known and/or convenient material or combination of materials. Framing elements 104 can also be non-toxic, made of food-grade material, and/or have antibacterial properties inherent in the material and/or as a coating on some or all of a plurality of framing elements 104. In other embodiments, framing elements 104 can have any other known and/or convenient properties or combination or properties. As shown in FIG. 1, framing elements 104 can be rigid, but in alternate embodiments framing elements 104 can be semi-rigid or flexible. FIG. 1 shows framing elements 104 as having smooth exterior surfaces. In alternate embodiments, the exterior surfaces of framing elements 104 can have ridges, indentations, raised portions or any other known and/or convenient surface characteristics. At least one of a plurality of framing elements 104 can be opaque, semi-opaque or transparent, and at least one member of a plurality of framing elements 104 can have a level of transparency different from that of other members of a plurality of framing elements 104. Additionally, all members of a plurality of framing elements 104 can be the same color. Alternatively, at least one member of a plurality of framing elements 104 can be a color different than other members of a plurality of framing elements 104. In yet other embodiments, at least one member of a plurality of framing elements 104 can be multi-colored.

Figure 2:
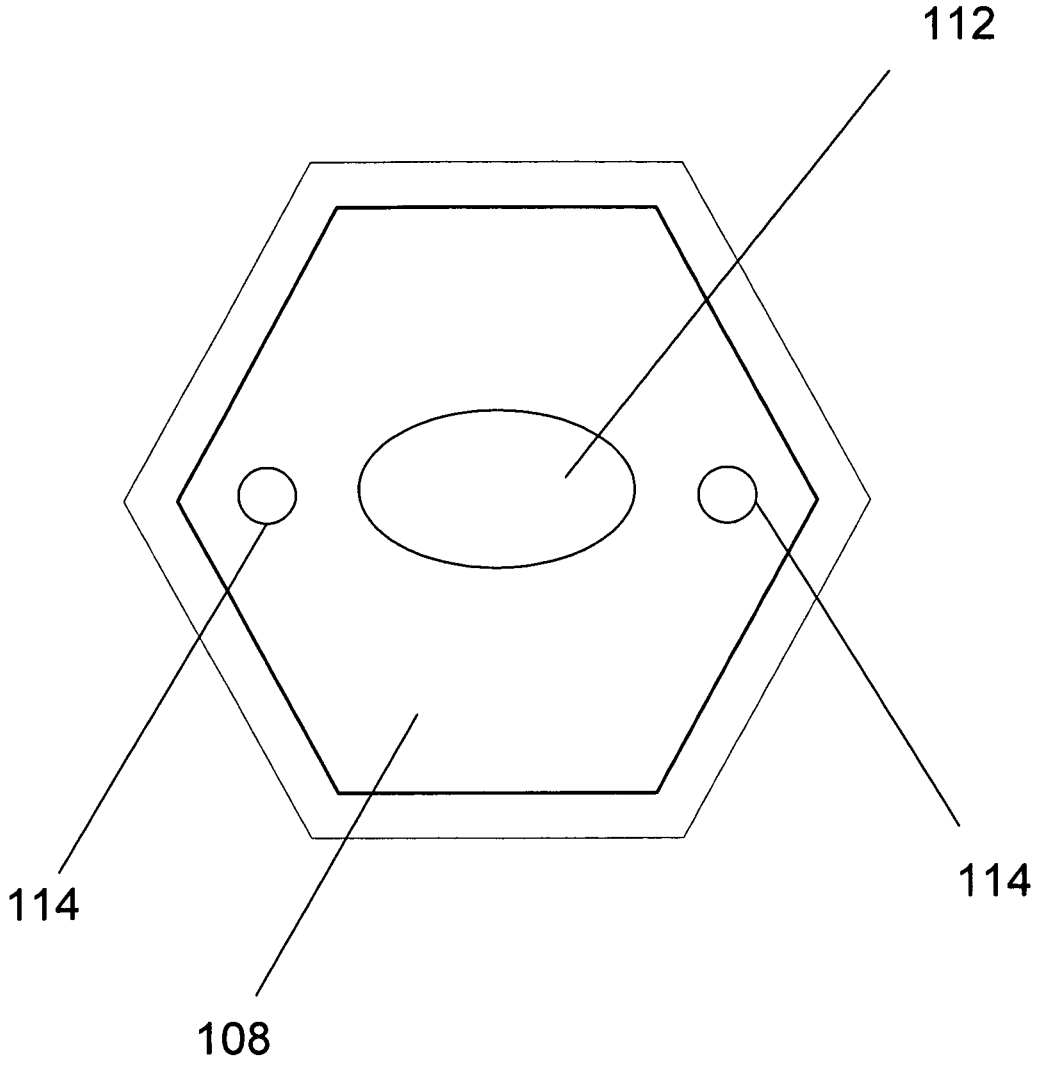
FIG. 2 depicts a front view of a substantially planar member of the present device.

A hollow-bodied member 102 can also have a nipple assembly 110 and at least one substantially planar surface 108 having a front side and a back side. As shown in FIG. 2, a substantially planar surface 108 can have an opening 112 adapted to allow a nipple to pass through. FIGS. 1 and 2 show a substantially planar surface 108 as hexagonal, however in alternate embodiments a substantially planar surface 108 can be square, circular, triangular or can have any other known and/or convenient geometry. As shown in FIG. 1, a framing element 104 can frame the perimeter edge of a substantially planar surface 108. A substantially planar surface can also have a plurality of safety apertures 114 as defined in and required by the U.S. Consumer Product Safety Commission, Office of Compliance, 16 C.F.R. 1511 (2003).

A substantially planar surface 108 can be made of plastic, metal, wood, polymer or any other known and/or convenient material or combination of materials, and can be rigid, semi-rigid or flexible. A substantially planar surface 108 can also be comprised of the same material as a plurality of framing elements 104, as shown in FIG. 1. In alternate embodiments, a substantially planar surface 108 can be made of a different material or combination of materials than a plurality of framing elements 104. A substantially planar surface 108 can be non-toxic, made of food-grade material, and/or have antibacterial properties inherent in the material and/or as a coating. In other embodiments, a substantially planar surface 108 can have any other known and/or convenient properties or combination or properties. In alternate embodiments, the exterior surface of a substantially planar member can be smooth or can have ridges, indentations, raised portions or any other known and/or convenient surface characteristics. A substantially planar member 108 can be opaque, semi-opaque or transparent. A substantially planar member 108 can also be one color or can be multi-colored.

Figure 3:
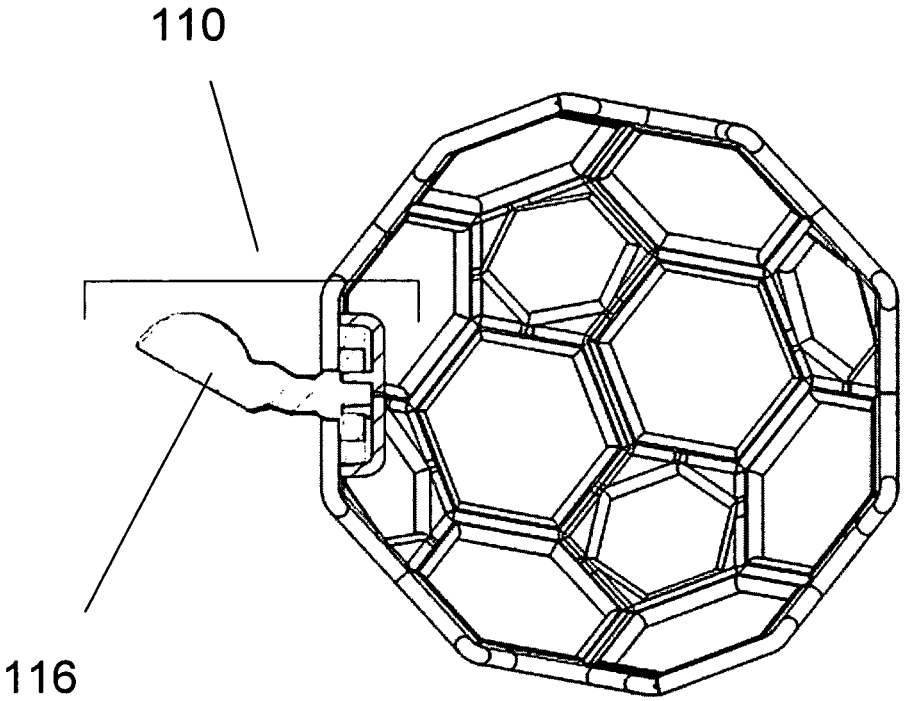
FIG. 3 depicts a cross-section of the embodiment of the present device shown in FIG. 1.
Figure 4:
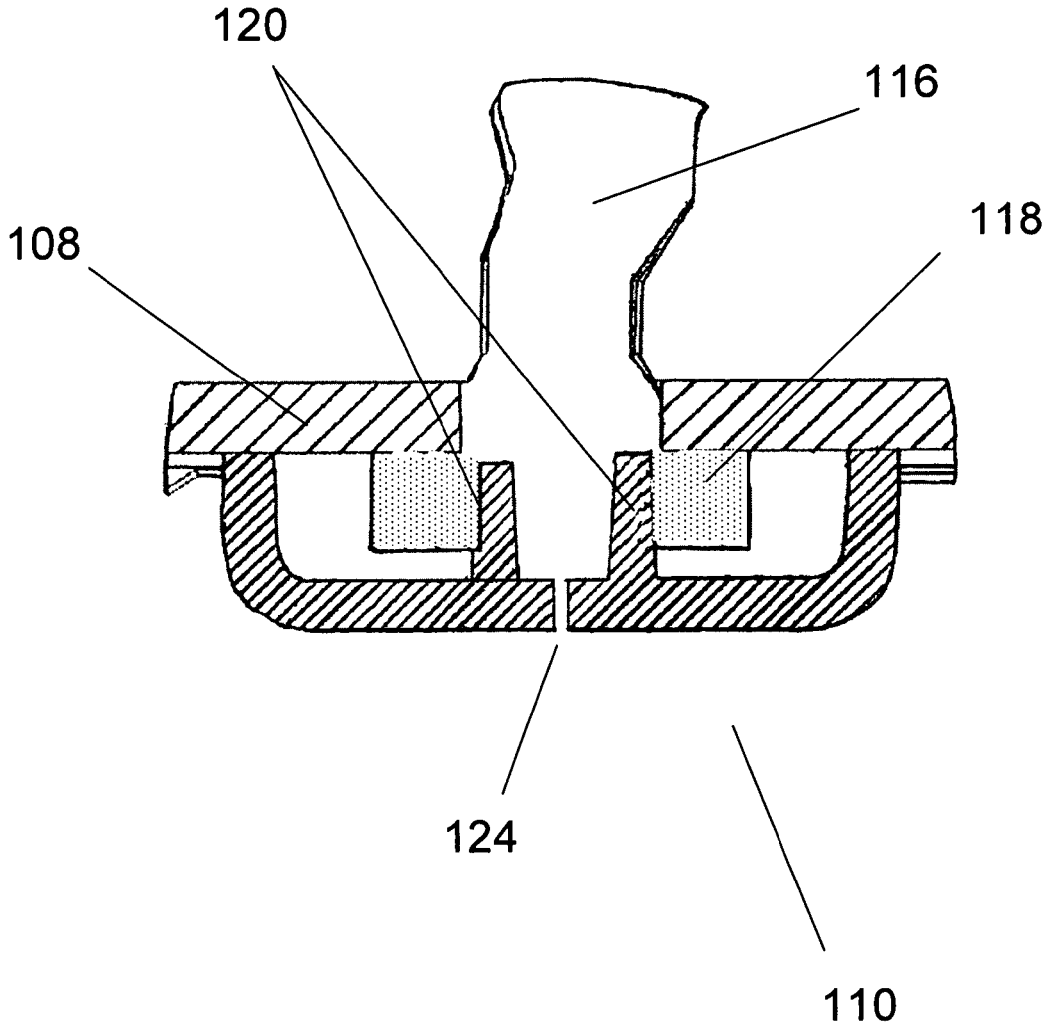
FIG. 4 depicts a cross-section of the nipple assembly of the embodiment shown in FIG. 1.

FIG. 3 depicts a sectioned view of an apparatus 100 comprised of a hollow-bodied member 102 and a nipple assembly 110. FIG. 4 depicts a portion of the sectioned view shown in FIG. 3, isolating the nipple assembly 110. A nipple assembly 110 can comprise a nipple 116, a plug member 120 and a nipple assembly cap 122. A nipple 116 can be any known and/or convenient pacifier nipple adapted for use with a baby or small child, and can have any known and/or convenient geometry. A nipple 116 can also have a flange 118 at its base that can have a perimeter larger than an opening 112 of a substantially planar surface 108.

As shown in FIG. 4, the perimeter of a nipple assembly cap 122 can be raised and can have any known and/or convenient degree of curvature. By way of a non-limiting example, the embodiment shown in FIG. 4 has a rim extending out from the periphery of the nipple assembly cap 122. In other embodiments, the perimeter of a nipple assembly cap 122 can be straight-edged and/or orthogonal to the plane of the body of the nipple assembly cap 122. In yet alternate embodiments, the entire nipple assembly cap 122 can be bowl-shaped or can have any other known and/or convenient configurations. As shown in FIG. 4, the nipple assembly cap 122 can have a small orifice 124 that can allow air or liquids to travel in and out of the nipple assembly 110. The small orifice 124 can be located proximal to the center of the nipple assembly cap 122, or at any other known and/or convenient location.

The edges of a nipple assembly cap 122 can be secured to the back side of a substantially planar member 108. In the embodiment depicted in FIG. 3, the nipple assembly cap 122 is permanently coupled with the back side of the substantially planar member 108 via ultrasonic bonding. However, in alternate embodiments a nipple assembly cap 122 can be permanently bonded using adhesive or any other known and/or convenient method of permanent bonding. In yet other embodiments, a nipple assembly cap 122 can be removably coupled with the back side of a substantially planar member 108 such that a user can remove and/or replace a nipple 116.

Figure 5:
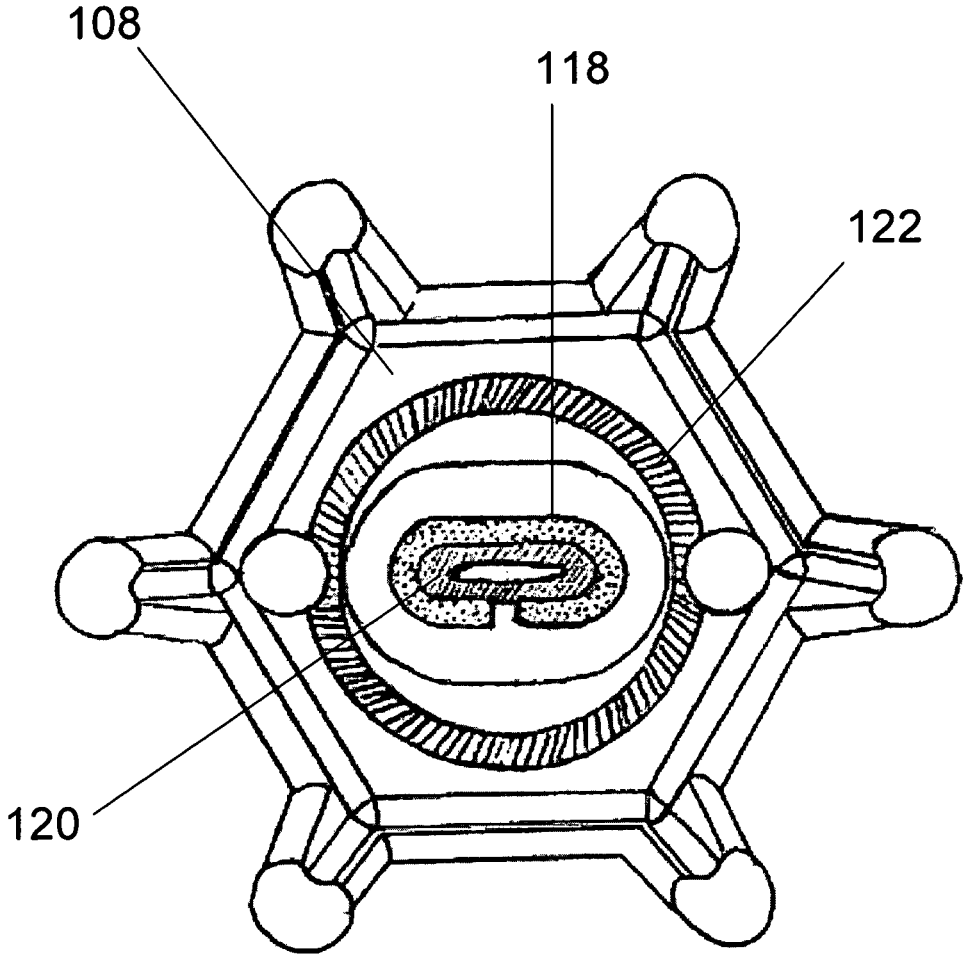
FIG. 5 depicts a cross-section of the nipple assembly as viewed from the back side of a substantially planar member of the embodiment shown in FIG. 1.

FIG. 5 shows a cross-sectional view of a nipple assembly 110, with the cross-section being parallel to the plane of a substantially planar member 108. As shown in FIG. 5, the flange 118 of a nipple 116 can have a substantially elliptical perimeter with one disjoint. In other embodiments, a flange 118 can have a perimeter of any known and/or convenient geometry, and the perimeter can be continuous or can have multiple disjoints.

As shown in FIG. 4, a plug member 120 can be substantially tubular and can be substantially orthogonal to the interior planar surface of a nipple assembly cap 122. The distal end of a plug member 120 can be coupled with and located proximal to the center of the interior surface of a nipple assembly cap. As shown in FIGS. 4 and 5, the proximal end of a plug member 120 can be open, and the plug member 120 can be positioned such that it does not block or cover the small orifice 124, thus allowing air or fluid to pass through the plug member 120 and orifice 124. A plug member 120 and/or a flange 118 can be rigid, semi-rigid or flexible, and can be made of plastic, metal, rubber or any other known and/or convenient material or combination of materials. FIG. 5 depicts a plug member 120 as having a substantially elliptical geometry and a continuous perimeter. In other embodiments, the perimeter of a plug member 120 can have any known and/or convenient geometry and can be non-continuous.

Additionally, in one embodiment the perimeter of a plug member 120 can be smaller than that of a flange 118 such that the plug member 120 and flange 118 frictionally engage when the plug member 120 is pressed into the interior surface of a flange 118. A plug member 120 and a flange 118 can be made of any known and/or convenient material or combination of materials such that when they are engaged, enough static friction is created to hold the engagement until a user pulls the plug member 120 out of the flange 118. In other embodiments, a plug member 120 and a flange 118 can have threaded interior and/or exterior surfaces, such that the plug member 120 and flange 118 can couple with each other via a screw-type mechanism. In yet other embodiments, the outer surface of a plug member 120 can have at least one raised portion adapted to mate with at least one indentation in the interior surface of a flange 118, thereby increasing the coefficient of static friction when a flange 118 and plug member 120 are engaged via a press-fit mechanism (as compared to a press-fit mechanism without such indentations and/or raised portions). Alternatively, a flange 118 and plug member 120 can be coupled with each other via any other known and/or convenient mechanism and/or method.

Figure 6:
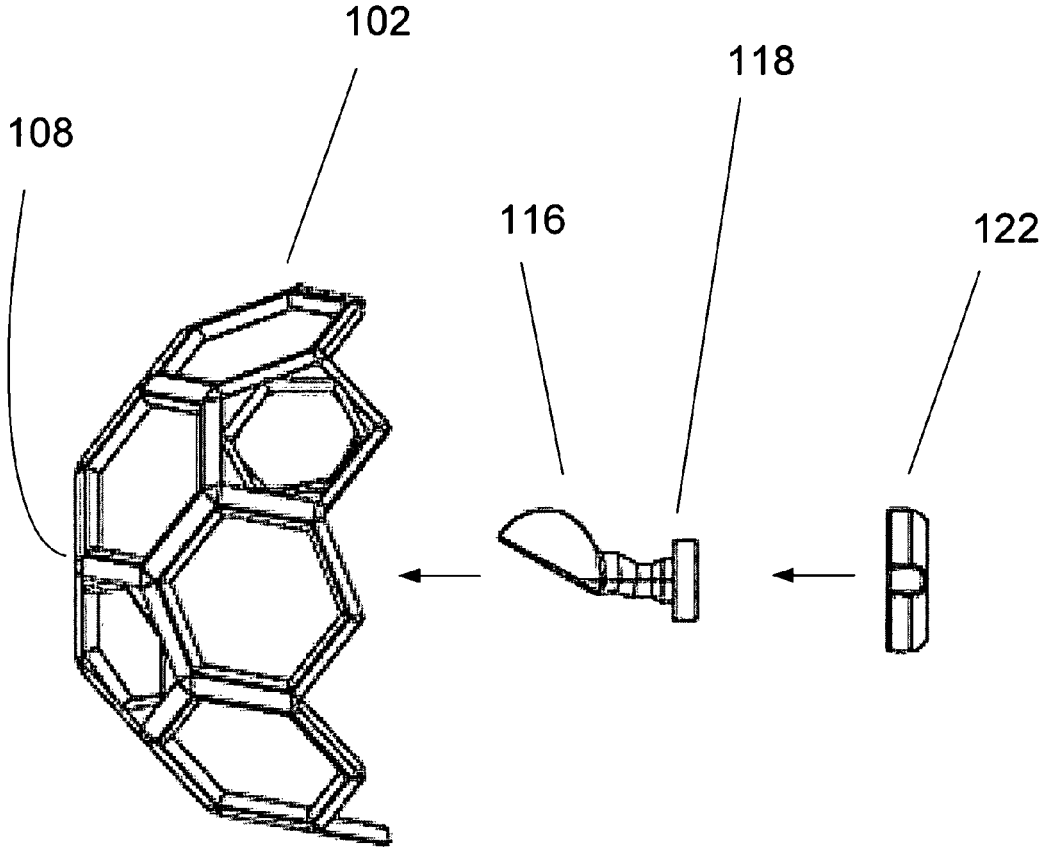
FIG. 6 shows a portion of one embodiment of the process of assembling the device shown in FIG. 1.
Figure 7:
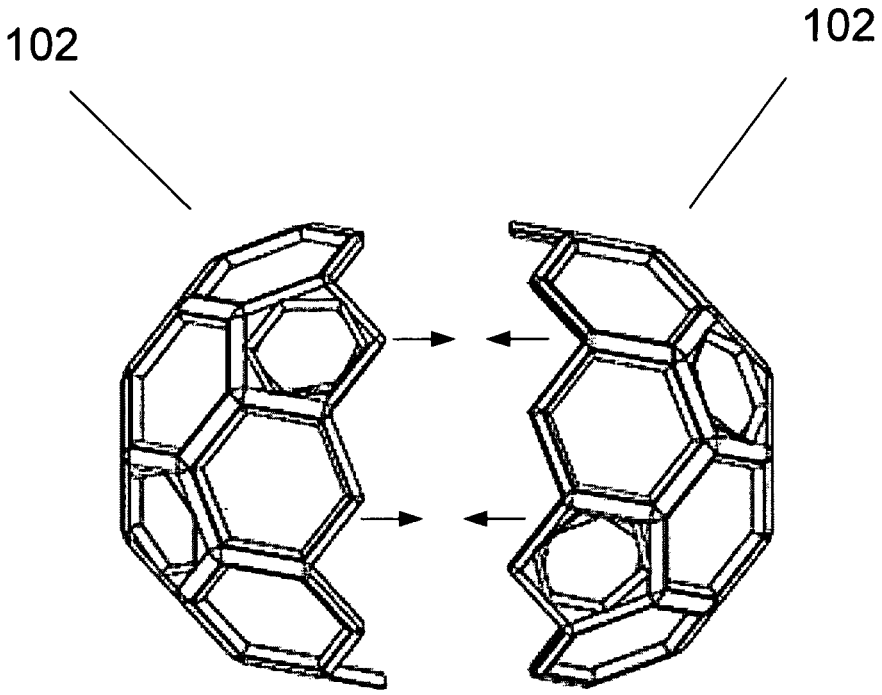
FIG. 7 shows another portion of one embodiment of the process of assembly the device shown in FIG. 1.

FIG. 6 depicts a portion of a process of assembling one embodiment of an apparatus 100. A nipple 116 having a flange 118 can be pushed through an opening 112 in the back side of a substantially planar member 108 of a portion of a hollow-bodied member 102 until the flange 118 comes into contact with the back side of the substantially planar member 108. A nipple assembly cap 122 can then be placed over the back side of the substantially planar member 108 such that the plug member 120 is pressed into the flange 118. As the plug member 120 is pressed into the flange 118, the flange 118 is pushed against the back side of the substantially planar member 108, thereby creating a frictional engagement between the flange 118 and both the plug member 120 and the back side of the substantially planar member 108. This action secures the flange 118 and nipple 116 to the substantially planar member 108. Subsequently, the edges of a nipple assembly cap 122 can be bonded to the back side of the substantially planar member 108 so that the entire nipple assembly 110 is secured to the back side of the substantially planar member 108. Finally, as shown in FIG. 7, the remaining portion or portions of a hollow-bodied member 102 can be bonded together to create the finished apparatus 100. In an alternate process, the nipple assembly cap 122 can be first pushed into the flange 118 of a nipple 116 and the entire nipple assembly 110 can subsequently be positioned within and bonded to a substantially planar member 108. In other processes, an apparatus 100 can be assembled by any other known and/or convenient means.

In use, a baby can suck on the nipple 116 while gripping a hollow-bodied member 102. If the baby drops the apparatus 100 on its lap or nearby, the apparatus 100 can be large enough for the baby to easily reach at least a portion of the hollow-bodied member 102, pick it up and place the nipple 116 back into his or her mouth.

Figure 8:
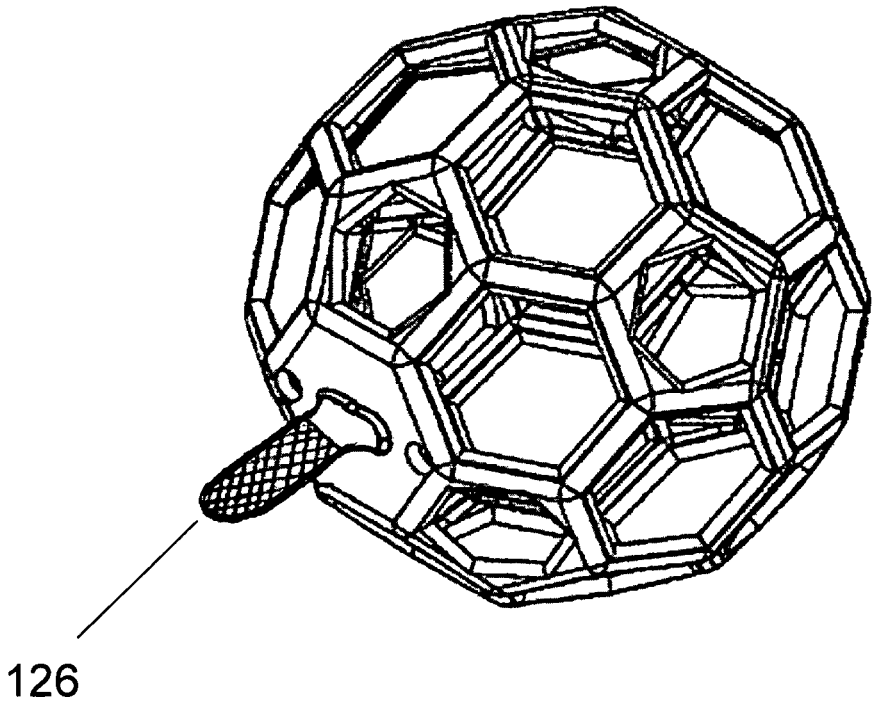
FIG. 8 shows an isometric view of another embodiment of the present device with a teething device in place of a nipple.

As shown in FIG. 8, an apparatus 100 can also have a teething device 126 in place of a nipple 116. A teething device 126 can be substantially planar and tongue-shaped, as depicted in FIG. 8, or can have any other known and/or convenient geometry. A teething device 126 can also have a textured surface, as shown in FIG. 8, or can have a smooth surface or any other known and/or convenient surface characteristics. A teething device 126 can be non-toxic, medical grade, and/or free of bisphenol A (BPA), or can have any other known and/or convenient and safe properties. Moreover, a teething device 126 can be flexible, semi-flexible or rigid, and can be filled with a gel or liquid that can be refrigerated or frozen to provide cooling relief to a teething baby.

An apparatus 100 can also serve as a toy when a child is not using the nipple 116 or teething device 126 by having at least one desired embellishment 140, such as crinkle paper, stuffed animals, musical implements, rattles and/or any other known and or convenient embellishment that can create an exciting apparatus for a small child or baby.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A pacifier apparatus, comprising:

a plurality of framing elements forming a hollow-bodied member, each of said plurality of framing elements comprising a plurality of elongated linear members that surround and define an aperture;

a planar surface defining an opening, said planar surface being coupled with one of said plurality of framing elements within the aperture defined by said one of said plurality of framing elements; and a nipple assembly comprising a nipple and a nipple assembly cap, said nipple having a flange extending out of a base of said nipple, said flange having an open center, and said nipple assembly cap having a rim extending out from the periphery of said nipple assembly cap and a plug member extending out from said nipple assembly cap proximate to the center of said nipple assembly cap, wherein said nipple assembly is coupled with said planar surface such that:

said nipple extends through said opening from a first side of said planar surface beyond a second side of said planar surface, said flange is positioned directly against said first side of said planar surface, said plug member is housed within said open center of said flange, and said rim of said nipple assembly cap is coupled directly to said first side of said planar surface around said flange such that said flange is positioned between said nipple assembly cap and said planar surface and said nipple assembly cap is within the interior of said hollow-bodied member.

2. The pacifier apparatus of claim 1, wherein the aperture defined by said one of said plurality of framing elements to which said planar surface is coupled is hexagonal.

3. The pacifier apparatus of claim 1, wherein the aperture defined by said one of said plurality of framing elements to which said planar surface is coupled forms an interior perimeter surface in said one of said plurality of framing elements, said interior perimeter surface being substantially orthogonal to the plane of said one of said plurality of framing elements, and said interior perimeter surface having a degree of curvature.

4. The pacifier apparatus of claim 1, wherein said planar surface further comprises a plurality of safety apertures entirely surrounded by portions of said planar surface.

5. The pacifier apparatus of claim 1, wherein said nipple assembly is removably coupled with said planar surface.

6. The pacifier apparatus of claim 1, wherein said nipple assembly cap further comprises an orifice located proximal to the center of said nipple assembly cap.

7. The pacifier apparatus of claim 1, wherein the aperture defined by said one of said plurality of framing elements to which said planar surface is coupled is different in size than said at least one aperture of another at least one member of said plurality of framing elements.

8. The pacifier apparatus of claim 1, wherein said hollow-bodied member is substantially spherical.

9. The pacifier apparatus of claim 1, wherein the exterior surface of at least one member of said plurality of framing elements has ridges.

10. The pacifier apparatus of claim 1, wherein said hollow-bodied member is coupled with at least one toy embellishment.

11. The pacifier apparatus of claim 1, wherein said nipple can be selectively replaced by a teething device.

12. A teething apparatus, comprising:

a plurality of framing elements forming a hollow-bodied member, each of said plurality of framing elements comprising a plurality of elongated linear members that surround and define an aperture;

a planar surface defining an opening, said planar surface being coupled with one of said plurality of framing elements within the aperture defined by said one of said plurality of framing elements; and a teething device comprising a teething portion and an assembly cap, said teething portion having a flange extending out of a base of said teething portion, said flange having an open center, and said assembly cap having a rim extending out from the periphery of said assembly cap and a plug member extending out from said assembly cap proximate to the center of said assembly cap, wherein said teething device is coupled with said planar surface such that:

said teething portion extends through said opening from a first side of said planar surface beyond a second side of said planar surface, said flange is positioned directly against said first side of said planar surface, said plug member is housed within said open center of said flange, and said rim of said assembly cap is coupled directly to said first side of said planar surface around said flange such that said flange is positioned between said assembly cap and said planar surface and said assembly cap is within the interior of said hollow-bodied member.

13. A pacifier apparatus, comprising:

a plurality of framing elements that collectively form a hollow-bodied member that is substantially spherical, said hollow-bodied member having a plurality of apertures each defined by a subset of said plurality of framing elements;

a planar surface defining an opening, said planar surface being coupled with one subset of said plurality of framing elements, such that said planar surface fills one of said plurality of apertures; and a nipple assembly comprising a nipple and a nipple assembly cap, said nipple having a flange extending out of a base of said nipple, said flange having an open center, and said nipple assembly cap having a rim extending out from the periphery of said nipple assembly cap and a plug member extending out from said nipple assembly cap proximate to the center of said nipple assembly cap, wherein said nipple assembly is coupled with said planar surface such that:

said nipple extends through said opening from a first side of said planar surface beyond a second side of said planar surface, said flange is positioned directly against said first side of said planar surface;

said plug member is housed within said open center of said flange, and said rim of said nipple assembly cap is coupled directly to said first side of said planar surface around said flange such that said flange is positioned between said nipple assembly cap and said planar surface and said nipple assembly cap is within the interior of said hollow-bodied member.

14. The pacifier apparatus of claim 13, wherein said plurality of apertures are each defined by a different subset of said plurality of framing elements.

15. The pacifier apparatus of claim 13, wherein said planar surface and at least one of said plurality of apertures are hexagonal.

16. The pacifier apparatus of claim 13, wherein said planar surface and at least one of said plurality of apertures are pentagonal.

17. The pacifier apparatus of claim 13, wherein said nipple assembly cap further comprises an orifice located proximal to the center of said nipple assembly cap.

18. A pacifier apparatus, comprising:

a spherical body comprising a plurality of elongated linear framing elements that surround and define a plurality of apertures in said spherical body, wherein said spherical body is hollow, at least one of said plurality of apertures is hexagonal, and at least one of said plurality of apertures is pentagonal;

a planar member coupled with said spherical body, said planar member being coupled with a subset of said elongated linear framing elements such that said planar member is within one of said plurality of apertures, wherein said planar member defines an opening proximate to its center;

a nipple comprising a nipple portion extending from the center of a flanged base; and a nipple assembly cap comprising a rim and a plug, said rim extending out from the peripheral edges of said nipple assembly cap and said plug being a hollow protrusion extending orthogonally out from said nipple assembly cap proximate to the center of said nipple assembly cap, wherein said nipple portion of said nipple extends through said opening in said planar member from a first side of said planar member beyond a second side of said planar member, such that said nipple portion extends out of an outer surface of said spherical body away from the center of said spherical body, wherein said flanged base has a perimeter wider than said opening in said planar member and said flanged base directly contacts said first side of said planar member, wherein said rim of said nipple assembly cap is coupled directly to said first side of said planar member around said flanged base of said nipple, wherein said flanged base has an open center on a side opposite to said nipple portion of said nipple and said plug of said nipple assembly cap is housed within said open center of said flanged base, and wherein said nipple assembly cap defines an orifice at the center of said nipple assembly cap, said orifice being an open passage extending linearly entirely through said nipple assembly cap into a hollow center of said plug.

* * * * *